US010577065B2

(12) United States Patent
Schmitz

(10) Patent No.: US 10,577,065 B2
(45) Date of Patent: Mar. 3, 2020

(54) HAND PADDLE

(71) Applicant: Ralf Schmitz, Frankfurt am Main (DE)

(72) Inventor: Ralf Schmitz, Frankfurt am Main (DE)

( * ) Notice: Subject to any disclaimer, the term of this patent is extended or adjusted under 35 U.S.C. 154(b) by 0 days.

(21) Appl. No.: 16/104,899

(22) Filed: Aug. 18, 2018

(65) Prior Publication Data

US 2019/0084660 A1 Mar. 21, 2019

(30) Foreign Application Priority Data

Sep. 18, 2017 (DE) ..... 10 2017 121 616

(51) Int. Cl.

| | |
|---|---|
| ***B63H 16/04*** | (2006.01) |
| ***B63H 16/10*** | (2006.01) |
| ***A63B 21/00*** | (2006.01) |
| ***A63B 23/12*** | (2006.01) |
| ***A63B 21/008*** | (2006.01) |
| ***A63B 23/035*** | (2006.01) |
| ***A63B 31/10*** | (2006.01) |

(52) U.S. Cl.

CPC ..... *B63H 16/04* (2013.01); *A63B 21/0004* (2013.01); *A63B 21/0084* (2013.01); *A63B 21/4035* (2015.10); *A63B 23/03533* (2013.01); *A63B 23/03541* (2013.01); *A63B 23/1209* (2013.01); *A63B 31/10* (2013.01); *A63B 2210/50* (2013.01)

(58) Field of Classification Search

CPC .... B63H 16/04; B63H 2016/04; A63B 31/08; A63B 31/10; A63B 31/12; A63B 31/18; A63B 21/0004; A63B 21/0084; A63B 21/4035; A63B 23/1209; A63B 23/03533; A63B 23/03541; A63B 2210/50

USPC ..... 441/55–59; 440/101

See application file for complete search history.

(56) References Cited

U.S. PATENT DOCUMENTS

| | | | | | |
|---|---|---|---|---|---|
| 4,233,925 | A | * | 11/1980 | Proctor | B63H 16/04 416/70 R |
| 4,493,663 | A | * | 1/1985 | Richmond | B63H 16/04 416/63 |
| 4,632,387 | A | * | 12/1986 | Guzman | A63B 21/0084 441/58 |
| 4,865,571 | A | | 9/1989 | Caramanica et al. | |
| 5,062,816 | A | * | 11/1991 | Berglund | A01K 77/00 416/74 |
| D353,573 | S | * | 12/1994 | Liveoak | D12/215 |
| D363,458 | S | * | 10/1995 | Killen | D12/215 |
| 5,795,201 | A | * | 8/1998 | Tibbetts | B63H 16/04 416/63 |
| 5,842,896 | A | * | 12/1998 | Liveoak | A63B 31/10 441/56 |

FOREIGN PATENT DOCUMENTS

| | | |
|---|---|---|
| DE | 3628637 A1 | 3/1988 |
| EP | 1498159 A1 | 1/2005 |
| WO | 2015-110824 A1 | 7/2015 |

OTHER PUBLICATIONS

EP Search Report, App. No. EP18192135 (dated Jan. 18, 2019).

* cited by examiner

*Primary Examiner* — Daniel V Venne
(74) *Attorney, Agent, or Firm* — Nwamu, P.C.

(57) ABSTRACT

A hand paddle. The hand paddle includes a stem having a handle and a blade, which is attached to the stem on either side of the handle. The handle may be attached for operating gentle, yet strenuous, water sports.

13 Claims, 4 Drawing Sheets

HAND PADDLE

BACKGROUND OF THE DISCLOSURE

This disclosure relates generally to the field of hand paddles and more specifically to sporting paddles for water sports.

A conventional hand paddle has, for example, oars or paddles for moving canoe, boat or the like in water. For this purpose, oars and paddles have a long, straight stem, at one end of which there is attached a flat component and at the other end there is a handle.

When rowing, the stem between handle and rudder blade is movably attached to the boat, so that when pulling the handle towards the body, the rudder blade is moved by the water away from the body. The athlete or competitor (and boat) thus moves. A paddle also has a long stem, at the end of which a blade is mounted and which has a handle on the end of the paddle located on stem remote from the blade.

During activity paddles are not attached to the boat. The athlete pulls the blade backwards through the water so that he moves forward. A paddle with a blade attached to each end of the stem also exists. In both rowing and paddling, the blade used to move through the water is attached to one end of the stem while the handle is at the other end or between two blades.

A water hand paddle, in which the blades are mounted in each case after the handles on the stem, is described in DE 36 28 637 A1. Leverage is then used to move.

It is within the aforementioned context that a need for the present disclosure has arisen. Thus, there is a need to address one or more of the foregoing disadvantages of conventional systems and methods, and the present disclosure meets this need.

BRIEF SUMMARY OF THE DISCLOSURE

Various aspects of a hand paddle for water sports can be found in exemplary embodiments of the present disclosure.

The hand paddle includes a stem; two mounts mounted on the stem; a handle; and a blade attached to the stem and the handle. The handle is located between the two mounts on the stem, where the two mounts attach the stem to the blade. In a further aspect, the hand paddle is a first hand paddle connected to a second hand paddle by a connector such as a stem connector.

A further understanding of the nature and advantages of the present disclosure herein may be realized by reference to the remaining portions of the specification and the attached drawings. Further features and advantages of the present disclosure, as well as the structure and operation of various embodiments of the present disclosure, are described in detail below with respect to the accompanying drawings. In the drawings, the same reference numbers indicate identical or functionally similar elements.

DETAILED DESCRIPTION OF THE DISCLOSURE

Figure 1:
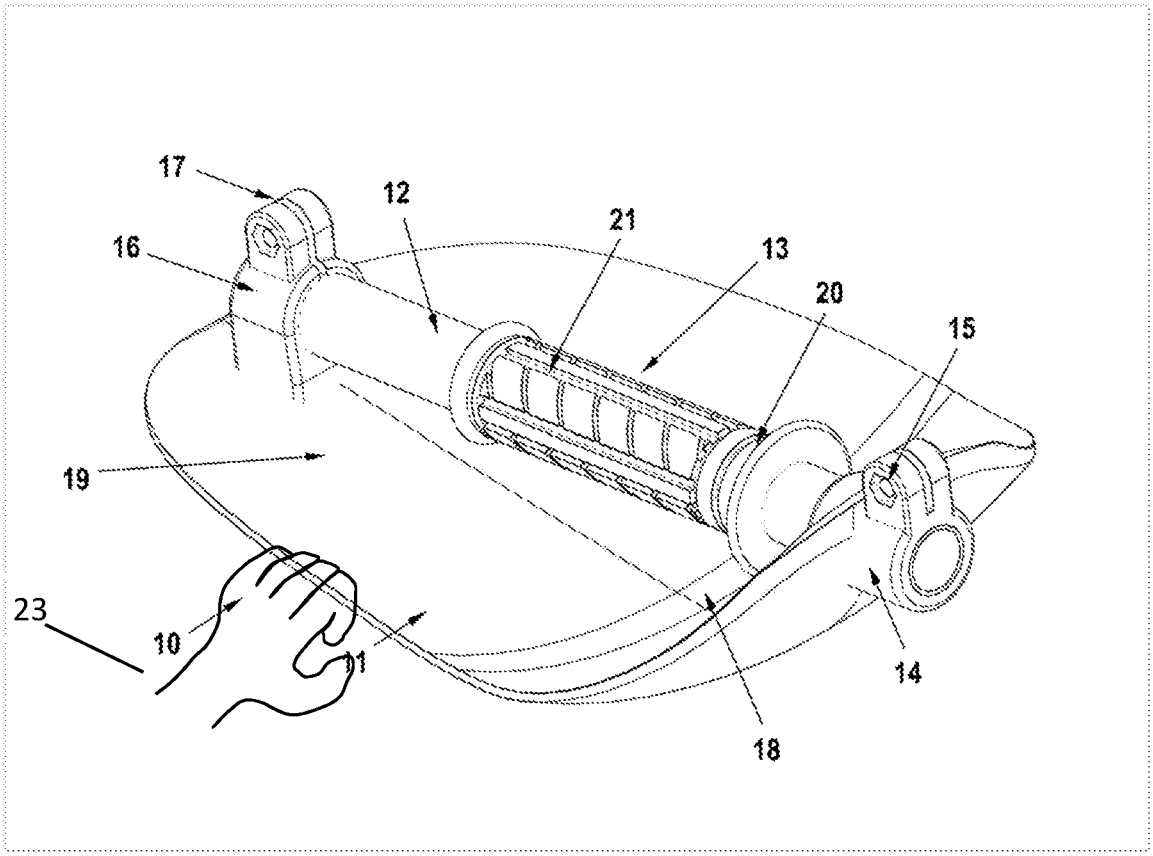
FIG. 1 schematically shows a hand paddle according to the disclosure with a single blade.

Reference will now be made in detail to the embodiments of the disclosure, examples of which are illustrated in the accompanying drawings. While the disclosure will be described in conjunction with the embodiment, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth to provide a thorough understanding of the present disclosure. However, it will be obvious to one of ordinary skill in the art that the present disclosure may be practiced without these specific details. In other instances, well-known methods, procedures, components, and circuits have not been described in detail as to not unnecessarily obscure aspects of the present disclosure.

In one embodiment, a blade is a component, which with suitable training of the musculature, has force against resistance such that the blade can be pulled through the water. For this purpose, a blade usually has a cd (coefficient of drag) value of between 1.0 and 1.5, preferably between 1.15 and 1.4. Blades which are completely flat towards the direction of motion (cd value of about 1.0-1.1) are suitable. However, more suitable blades have an area that has an open space against the direction of movement. An example of such a blade is an open hemisphere or half shell against the direction of movement. If such a blade is pulled through the water with the open side, it feels more stable.

Preferred are blades with a surface which has different angles of inclination with respect to the direction of movement through the water over its length and width. For example, blades formed like half mussel shells have such a shape. In order for the blade to produce sufficient water resistance, a water-impermeable or sufficiently large, non-perforated surface is preferred. A water resistance will be considered as sufficient, if the sportsman has to make a substantial effort to move the hand paddle perpendicular to the handle through the water.

The cd value of the blade can by various constructive measures be brought into the range in which it is useful for the disclosure. One of these factors is the work angle against the direction of movement. This can be influenced by the attachment of the handle and the angle of the stem to the blade. The work angle according to the disclosure is between 75 and 90 angular degrees, preferably between 85 and 90 angular degrees. Another factor is the surface area of the blade facing the direction of movement.

On one or more sides, it may have an angle greater than 80 angular degrees, preferably between 85 and 90 angular degrees, towards to the direction of movement in the water. The more one works with pressure against the water, you would think, the hand paddle would move faster through the water. That's not so! Only a small increase in speed is achieved, whereas the force be applied increases disproportionately. In this way, the same hand paddle is suitable for training by both stronger and weaker persons without constructive changes, or the same movement pattern can be applied with much or little force.

The components of the blade used to generate the water resistance are preferably formed from a lightweight material. It may be a uniform material, such as plastic, but also a composite material, such as reinforced plastic or carbon. Polypropylene is the preferred material for reasons of cost and flexibility, but this does not mean that other materials such as fiberglass or even carbon for higher quality blades are excluded.

The blade preferably has a basically uniform wall thickness. The wall thickness of the blade according to the disclosure is usually for the majority of it is surface between 1.2 mm and 1.5 mm, depending upon the material. The preferred thickness of the blade is in the surface is 1.3 mm, and in the area of the mounts is 5 mm. The flexibility of the blade can also be adjusted over the thickness even at different positions of the blade. It was found that it is pleasant for the sportsman for using the disclosure in water, if the blade is not completely rigid. A displacement at the edge by up to 10 cm, preferably between 1.2 cm and 1.5 cm, when moving through the water has proved to be joint-friendly, even under extremely high load, since the force development can be gentle. As a material, plastic has proven to be particularly suitable for the flat portion of the blade, which contributes the most to water resistance.

In addition to the cd value, the size of the cross-sectional area through which the water resistance is generated also has an influence on the force which the athlete has to apply in order to move the hand paddle through the water. In this context, this area does not mean the area of the surface of the blade but the area of the projection of the blade onto the area perpendicular to the direction of movement.

Thus, for the example of a hemispherical blade moving through the water with the open side, this is not the (half) spherical inside surface but the area of the cross section through the (imaginary) sphere. The water resistance effective area of the blade may thus have an area of between 100 and 2000 $cm^2$, whereby smaller area hand paddles require less power. This is better for beginners or children, while larger area device is for training experienced people with stronger musculature better suited. For adults with average strength, an area of between 600 and 1000 $cm^2$ is appropriate.

The blade is attached to the stem with two mounts. This stem has a handle through which the hand paddle can be gripped and moved through the water.

The stem extends between the two mounts of the blade. It can therefore have any form that ensures this function. In its simplest form, it may therefore be a handle with a round cross-section. Preferably, the stem is tubular. The stem is so long that it can be held on the one hand by the mounts, and on the other hand that it can pick up or form the handle. The minimum length is therefore determined by the distance of the mounts from each other.

This, in turn, is dictated by the fact that the handle is between the mounts and is thus dictated by the width of the athlete's hand. The maximum length is given by the dimensions of the blade. The stem should not or not substantially protrude beyond the cross-sectional area of the blade, because otherwise this could lead to injury from the protruding part. The stem therefore usually has a length of between 20 cm and 30 cm; preferred are 25 cm. The diameter of the stem is preferably between 15 mm and 40 mm, more preferably between 20 mm and 30 mm. If you use a tube with a diameter of 24 mm, you can use a standard handle grip of a bicycle as a handle.

The stem is made of a material that is strong enough to hold the handle in a fixed position towards the blade. Suitable for this purpose are metals or plastics. If the hand paddle is to be particularly light, light metals have proved to be preferred. In addition, it must not corrode.

Aluminum is particularly preferred because it is relatively corrosion resistant in water and yet very light. If the hand paddle has to be particularly inexpensive, the stem can also be made of plastic, in particular of the plastic, from which the blade is made. This also relieves the production, since then the hand paddle can be produced in an injection molding step.

The handle may be part of the stem or a component attached to the stem, which largely or completely encompasses the stem, so that the stem can be gripped largely or completely by hand. The size of the hand therefore essentially determines the circumference of the handle. The circumference is thus preferably between 8 cm and 20 cm.

In the simplest form of the disclosure, a part of the stem itself is used as a handle. This is useful if the hand paddle should be inexpensive. In a first finish, the stem is a long component with a round cross-section, which is so large that it can be easily gripped and held by hand. The diameter is then between 2 cm and 6 cm, preferably between 2.5 cm and 4 cm, in which a small diameter for smaller hands, like hands from children, is advantageous. A separately mounted handle is then no longer necessary because part of the stem serves as a handle. However, this has the disadvantage that it is more difficult to grasp and hold the handle without the hand slipping on the stem during the exercises.

Another embodiment is characterized in that the stem and handle are made of the same material, and that the handle is formed from the material of the stem, to ensure better tangibility of the handle. This embodiment is particularly easy to manufacture if the hand paddle is made of plastic, since the device can be then produced by injection molding. In this case, the plastic can be ergonomically shaped in the region of the handle, so that it is designed to be handy.

In a more comfortable or better for training suitable form of the handle on the stem is formed separately. So, it is independent of the shape of the stem. The shape is designed so that you can hold it well with your hand. This can have approximately the shape and size of a conventional bicycle handle's handle made of soft plastic. So that the hand cannot slip in the direction of the mounts, extensions can be provided on the sides of the handle. In one embodiment, the handle is a cylindrical piece of rubber, which is pushed in the installation of the stem made of aluminum tube to the desired position.

The material of the handle is chosen depending on the desired configuration. Particularly suitable are soft plastics that are easy to work with, and which are skin-friendly and safe to the touch.

The handle may be located somewhere between the mounts. To ensure better training performance, the handle is fixed on the stem, so that the hand paddle is always firmly gripped in the same point. This is preferably chosen so that the force can be distributed by the hand as evenly as possible on the hand paddle, so that the effective surface against the water resistance is as perpendicular to the direction of movement of the hand paddle. This point is preferably located in the symmetrically shaped blade nearer the thumb, where is the front third of the stem, provided that the mounts are located respectively at the outer ends of the blade. If the water resistance on one side of the blade is increased, the handle will usefully continue to be shifted to this side. This serves a uniformly training.

The mounts connect the blade to the stem. This connection can be permanent, but also temporary. During training, a secure attachment of the blade to the stem should be ensured. If the hand paddle is to be dismantled, mounts can be selected in which the stem or the blade can be removed from the mount, or in which the mounts can be disengage. An embodiment with permanent connection results when the hand paddle is to be made of a single material, such as plastic, by injection molding. In multi-step manufacturing processes, the handle may be permanently attached to the blade or stem and connected to the stem or blade to complete or provide the hand paddle. The connection can be done by conventional methods. For this purpose, pushing, screwing, clamping, engaging or a combination of one or more of these methods are suitable.

In a first embodiment, the mounts are located on the side of the blade or the hand paddle on which the stem is located and which is on the side of the direction of movement of the device. Preferably, the area of the blade encloses the space around the handle at between 5% and 75%.

The mounts have an inclusion for the stem, in which it is then secured by screws. The mounts are attached to the blade so far from each other that on the stem there is still place for the handle.

In another embodiment, both mounts can be in the form of openings in the blade.

In a preferred embodiment of the arrangements of the handles and the stem on the blade, the first handle is part of the blade on the side of the hand paddle which is on the side of the direction of movement. For this purpose, a component is provided at the one end of the blade, which projects in the direction of movement on the stem and has a receptacle for the stem, for example, a round opening with the outer shape of the stem.

The stem is screwed into the receptacle on the one hand and clamped on the other side. The second mount is formed by a hole in the blade into which the stem is received, for example a round hole with the outer shape of the stem extending from the inside of the blade to the outside through which the stem can extends from the inside to the outside. Fasteners, such as screws or clamps, may then be provided on the inside or outside of the blade. Again, the two mounts are so far away from each other on the blade, that there is place between them for the stem with the handle.

The mounts and stem also serve to hold the handle so far away from the blade that the hand does not come into direct contact with the blade when grasping the hand paddle on the handle, and especially during the practices. This is guaranteed if the distance of the handle from the blade is more than 5 cm. Advantageously, the distance is between 5.5 and 11 cm.

In a particularly preferred embodiment of the disclosure, the blade is formed from a strongly rounded, rectangular, curved plastic plate with a width of 20 cm and a length of about 30 cm, but not more than 50 cm. The edges of the plate are bent in the direction of the handle, so that forms a hollow interior, wherein the edge on one side protrudes beyond the stem, so that the stem protrudes through an opening in the plate from the interior to the outside.

The hand paddle according to the disclosure can be produced by conventional methods. If the hand paddle is entirely made of plastic, it can be injection molded from a thermoplastic such as PP and PE. The blade including mounts is preferably made by injection molding of PP. If individual components are to be made of other plastics, for example softer materials, such as the handle, the hand paddle can be produced in a two-component injection molding process. If the hand paddle is made of different materials, the individual components can be manufactured separately and then they can be assembled. This is the case when individual components, such as the stem, should be made of metals, others made of plastic.

The hand paddle according to the disclosure can be used to do water sports. This includes a sport, which is operated in the water in one place. For this purpose, the athlete goes into the water, standing or free to move, grips the hand paddle with one hand firmly by the handle and moves the hand paddle through the water. The movement can be both horizontal and vertical. The exertion and thus the training effect can be adjusted by how the hand paddle is gripped by the handle, so that different work angles of the blade, towards the direction of movement, arise.

The effort is highest when the cd value reaches the highest value. This is usually the case when the effective area of the blade with respect to a particular direction of movement is greatest for the water resistance. You can do the same practices with a lot or with little effort. An example of a practice with the hand paddle according to the disclosure is the gripping of the handle with the arm extended so that the interior of the blade points towards the athlete. The hand paddle is moved towards the athlete by tensing the arm muscles and then returned to the starting position. Another practice is gripping the hand paddle by the hand with the arm outstretched so that the interior of the hand paddle faces down.

The hand paddle is moved towards with the arm extended and returned to the starting position. In contrast to many other hand paddle (such as elastic bands), the muscles are not only trained in bending the arm muscles, but also during stretching of the arm muscles during the return to the starting position. The movement in the water also ensures that balancing movements throughout the body are required so that the body remains in place and does not fall forward or backward. Thus, the stabilization muscles of the spine are trained. The hand paddle according to the disclosure therefore ensures a gentle load on a variety of muscle groups by a gentle force development.

However, the hand paddle according to the disclosure can also be used for locomotion through the water. One way to do this is to swim in the familiar crawl style. For this purpose, each hand takes one of the hand paddles according to the disclosure. Alternately, a hand paddle is guided through the air from back to front, while the other is pulled from front to back through the water. The water resistance generated by the blade is translated forward in a movement of the athlete. The use of the hand paddle according into the disclosure for swimming is not quite as easy as it seems, but skilled swimmers can learn the new techniques quickly.

The blade according of the disclosure preferably has a curved, oval, oblong shape. The said blade describes the shape of a shovel, which has a central handle in the longitudinal direction. The hand paddle according to the disclosure generally has a length of about 30 cm, a width of about 20 cm and at the lowest point a depth of about 12 cm to 15 cm.

The hand paddle according to the disclosure may contain other components. This can be a component that can be used to connect to another hand paddle. If the other hand paddle is another hand paddle according to the disclosure, the component is preferably a connector, for example a stem connector, which can be attached to the second hand paddle. For attachment of this stem connector, mounts are available either on the stem connector or on one or both hand paddles. Because of the rapid solubility clamping brackets are preferred. In one embodiment, one of the mounts of each of the two hand paddles is used to secure the stem to the blade and it is also used to secure the stem connector.

The shape of the connector or stem connector is chosen so that the two connected hand paddles can be gripped in each case with one hand on each handle and that it firmly connects the two individual hand paddles with each other, preferably via their stems with each other. For this purpose, the stem connector is so long that the two hand paddles have a sufficient distance for training. In a more comfortable version, the length of the stem connector is variable, so that different practices can be trained. In general, the stem connector is so long that the stem connector can be completely sunk in the hand paddle according to the disclosure, so that nothing protrudes.

This avoids the risk of injury. The distance between the handle of the two hand paddles is between 40 cm and 1.2 m, preferably between 50 cm and 1 m. An advantageous embodiment is obtained when the stem connector has an outer shape which can be received in the interior of the stem of the first hand paddle so that it can be stored therein. For this purpose, the stem of the first hand paddle is preferably a hollow tube with a first inner diameter, and the stem connector is a tube with an outer diameter which is slightly smaller than the inner diameter of the stem of the first hand paddle. The tubes are preferably straight.

One embodiment of the disclosure includes a set containing two hand paddles according to the disclosure. Both arms can be trained at the same time by grasping the two hand paddles with the right and the left hand and moved through water. If these hand paddles are not connected to each other, practices can be performed in which the two hands make movements in different directions. For example, the first hand paddle can be moved downwards while the second is moved upwards.

This set may further include a stem connector for attaching the two hand paddles together. It may be contained loose in the set, but also be attached to one of the two hand paddles. This set may contain the individual hand paddles in a separate form as a set, but the individual hand paddles can already be connected to each other via the connector.

Another embodiment is a hand paddle containing two of the above-described hand paddles according to the disclosure, each with a blade which are fixedly connected to each other by a connector or a stem connector. With this hand paddle both arms can be trained. For this purpose, each hand grips one of the two handles and moves the hand paddle substantially perpendicular to the handles. If the distance of the handles, for example, by different lengths of stem connectors, is changed, different muscle groups can be trained.

Another embodiment of the disclosure is the use of the device according to the disclosure for doing water sports using the hands. An example of water sports is swimming. Water sports are preferred by moving the hand paddle either alternately up and down or back and forth to the body.

FIG. 1 schematically shows a first embodiment of the hand paddle (10) according to the disclosure.

It has a blade (11) which has a thumbs side (18) and a small fingers side (19). On its thumbs side (18), the blade is fastened with a first mount (14) to a stem (12) in the form of a tube. The mount (14) is a clamp bracket that has a receiving opening that surrounds the tube right down to a slot. In the embodiment shown, the stem (12) protrudes through the blade (11), the mount (14) comprises the receiving opening for the stem (12). The mount extends from the handle as seen on the outside of the blade. By tightening the set screw (15) the slot is demagnified and the circumference of the opening reduced, whereby the mount clamps the tube.

On its small fingers side (19) the blade is attached to the stem (12) by the second mount (16) is attached to the stem (12). The mount (16) provides a sufficient distance between the blade from the stem and also has a receiving opening which surrounds the tube right down to a slot. On the side facing away from the blade (11) of the stem, the mount (16) is provided with a set screw (17). By tightening the set screw (17), the slot is demagnified and the circumference of the opening reduced, whereby the tube in the mount (16) is clamped.

Between the mounts (14, 16), the stem has the handle (13). It is marked in the drawing for better visibility with circumferential rills. It encloses the tube and serves for gripping the hand paddle (10) by hand and for the holding during sports exercises. In this case, the thumb is on the right side of the handle when grasping with the left hand (seen by the viewer in FIG. 1), the thumbs side (20) of the handle, the little finger to the left, in the vicinity of the small fingers side (21) of the handle. The handle (12) is located on the inside (25) of the blade. Of course, you can use the grip method diametrically reversed.

Figure 2:
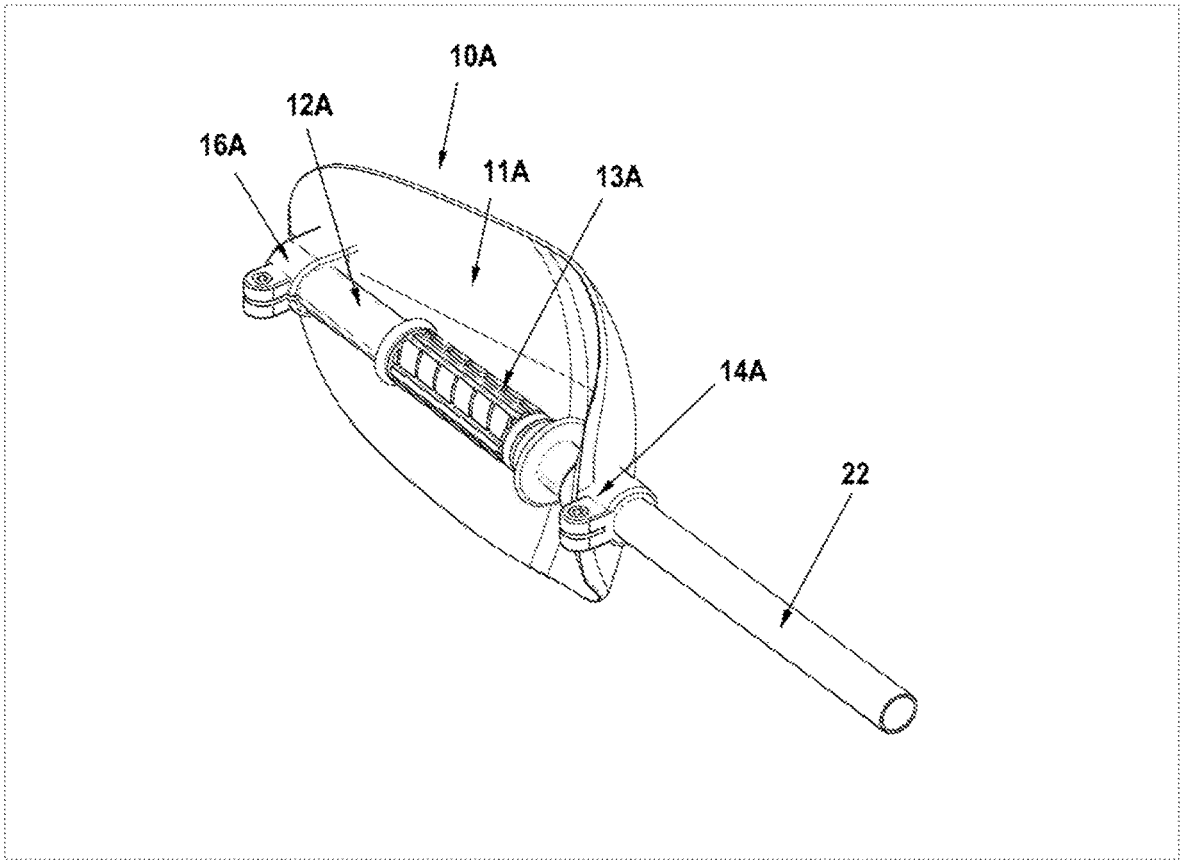
FIG. 2 schematically shows the hand paddle according to the disclosure with a stem connector, by which a second hand paddle can be firmly connected to the first hand paddle.

FIG. 2 schematically shows the hand paddle according to the disclosure with a stem connector (22).

The components correspond to the reference numerals with the designations A, the reference numerals in FIG. 1 without designation A. The stem connector (22) is formed as an extension of the tube, which has a slightly smaller outer diameter than the tube which forms the stem (12A). Therefore, the stem connector (22) can be inserted into the tube and can be countersunk therein. Further, the stem connector (22) is clamped by the mount (16) in the stem (12), so that it cannot be completely pulled out of the stem. The mount (14A) is an opening in the blade, the attachment is made by a screw on the outside (26) of the blade.

Figure 3:
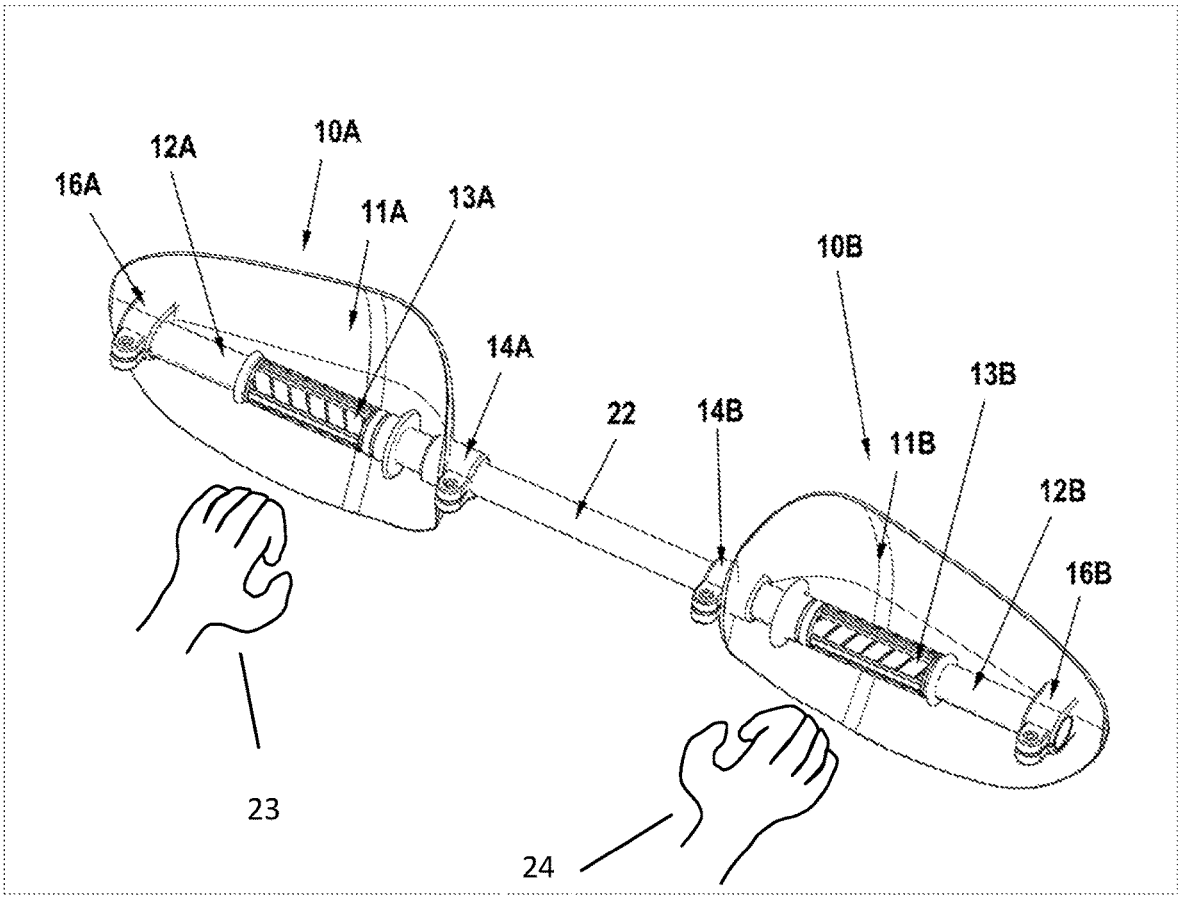
FIG. 3 schematically shows a hand paddle according to the disclosure with two blades, which are firmly connected to each other via a connecting piece.

FIG. 3 shows schematically the hand paddle with a stem connector (22), which firmly connects another hand paddle according to an example of the disclosure.

The reference numerals of the second hand paddle have the additional designation B, but otherwise they correspond to the reference numerals of the first hand paddle. The second hand paddle is also fixedly connected to the stem connector (22) via one of the mounts (16A) in the first hand paddle corresponding mount (16B) of the second hand paddle. As a result, the hand paddles are mirror-imaged connected to each other via the stem connector. This makes it possible to grip the handle of the first hand paddle with the left hand (23) and the handle of the second hand paddle with the right hand (24). The thumbs sides of the hands preferred show towards each other. For another practice, the grip can be performed diametrically opposite.

Figure 4:
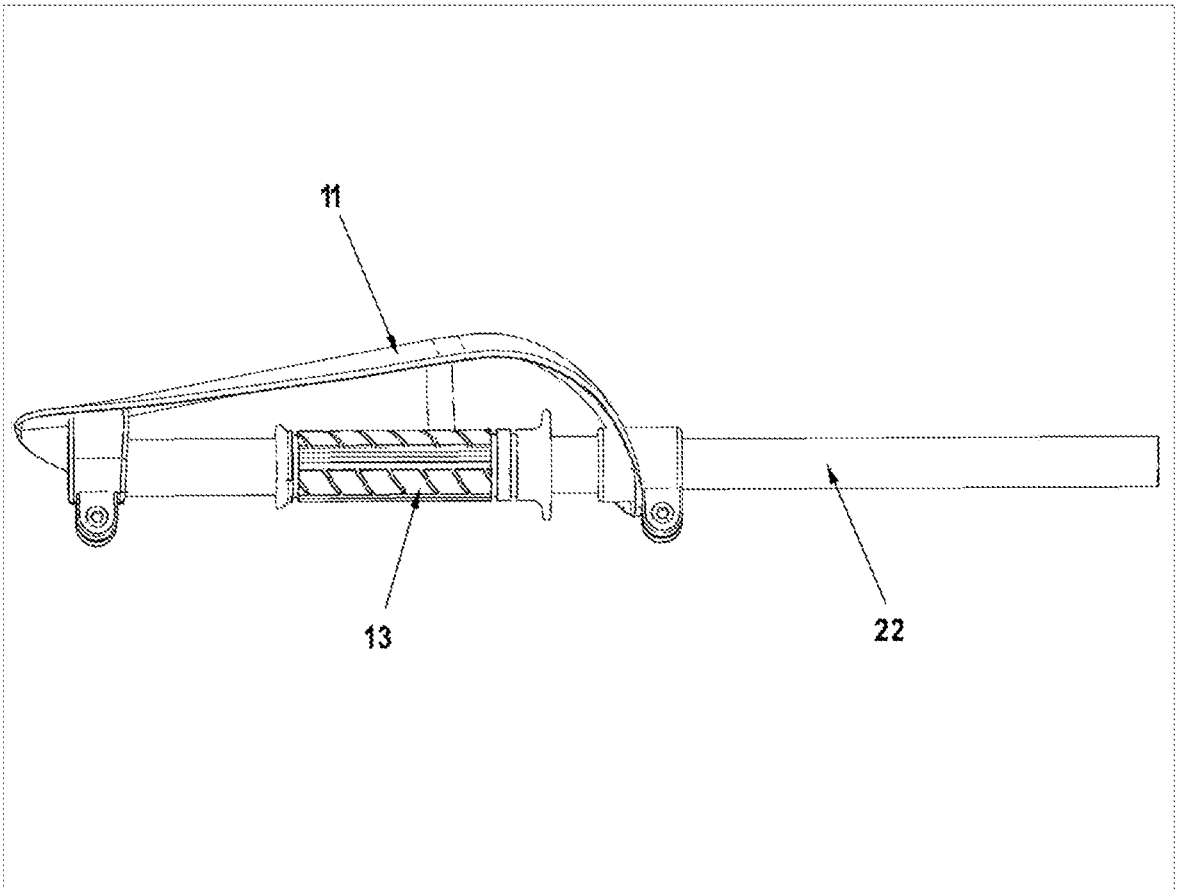
FIG. 4 shows a hand paddle according to the disclosure seen from the side.

FIG. 4 from a side view shows a hand paddle according to the disclosure as manufactured and used in the examples. You can see the blade (11), the extension stem (22) and the handle (13).

LIST WITH REFERENCE SIGNS

10 Hand paddle
11 Blade
12 Stem
13 Handle
14 First mount
15 First set screw
16 Second mount
17 Second set screw

18 Thumbs side of the blade
19 Small fingers side of the blade
20 Thumbs side of the handle
21 Small fingers side of the handle
22 Stem connector
23 Left hand
24 Right hand
25 Interior of the blade
26 Exterior of the blade

EXAMPLES

Example 1—Manufacturing a Hand Paddle with a Single Blade

The curved blade is made of polypropylene, the shape is as shown in FIG. 4. It is manufactured by injection molding. The two mounts are also made of polypropylene and are attached to the blade during injection molding. The mount, which is closer to the flattened part of the blade, has a circular opening with a clear diameter of 2.5 cm and a slot with a circumference of 0.4 mm clearance, which is used to clamp the stem in the opening, which can be downsized by means of a screw. The second mount is formed by a hole on the steeper side of the blade. The opening is also 2.5 cm wide and has on the outside of the blade a clamping device of the same type as in the other mount.

A straight piece of bicycle handle with an outer diameter of 2.4 cm is inserted through the second mount in the interior of the blade. Then a gummed bicycle handles whose outer end has been cut off so that the tube can escape from the handle, is pushed onto the bicycle handle until the tube protrudes from the handle, and the bicycle handle is pushed further into the blade until it can be inserted in the first mount. There it is clamped with a screw. Thereafter, the slot of the second mount is closed by tightening the screw and thus the stem is fixed in the mounts. Thereafter, the handle is brought to its final position.

Example 2—Swimming with the Hand Paddle

Breaststroke

When breast stroking almost all muscles are in use. The hand paddle is held in front of the user and is pulled in a circular motion backwards and away. Then the wrists are moved in an upward rotation and the sports paddle pushed with little to no resistance back to the front. The leg movement is performed normally.

Crawl

In crawling, almost all muscles are also in use. The technique is also easy to learn by changing a few things in the movement sequences. You plunge one of the hand paddles in front of you and pull it back down. Then you do with the wrists an inward rotation, thus reducing the resistance. While the first hand leaves the water at the hip to push forward, the other hand plunges into the water and does the same movement as previously described. The leg movement is performed normally.

Backstroke

During backstroking, almost all muscles are in use again. In the technique you lie on your back and stretch your arms sideways in the water. Then you pull the blades to your thighs. By turning the wrists, there is the resistance of the blades reduced and stretched out again at chest level. Then the movement starts from the beginning. The leg movement is performed as in breast stroking.

Back Crawl

When back crawling almost all muscles are in use again. You lie on your back and extend one arm to the back. Then you draw the one blade with half a turn in a half curve to the buttocks. When one hand reaches it, you plunge the other hand in the water behind you. The hand that made the first strike comes up from the water and pulls back in the usual way. Then the movement starts from the beginning. The leg movement is performed as in crawling.

While the above is a complete description of exemplary specific embodiments of the disclosure, additional embodiments are also possible. Thus, the above description should not be taken as limiting the scope of the disclosure, which is defined by the appended claims along with their full scope of equivalents.

I claim:

1. A hand paddle comprising,
a tubular handle;
a blade with a concave surface curving toward the tubular handle;
a tubular stem separate from the tubular handle, the tubular handle having a hollow interior to receive a first end of the tubular stem; and
a plurality of mounts formed into oppositely disposed ends of the blade, one of the mounts being a hole formed in the blade to receive the first end of the tubular stem,
wherein the blade is attached to the tubular stem with the plurality of mounts, and wherein the tubular handle is located on the tubular stem between the plurality of mounts.

2. The hand paddle according to claim 1, wherein the tubular handle is located centrally in the longitudinal direction of the blade.

3. The hand paddle of claim 1 wherein the tubular stem includes a hollow interior that receives the connecting stem to connect to another hand paddle.

4. The hand paddle of claim 1, further comprising a connecting stem, wherein the hand paddle is a first hand paddle and the connecting stem connects the first hand paddle to a second hand paddle.

5. A set of hand paddles comprising:
a first hand paddle having a first tubular stem; a first plurality of mounts mounted on the first tubular stem; a first tubular handle; a first blade attached to the first tubular stem and the first tubular handle, wherein the first plurality of mounts are formed into oppositely disposed ends of the first blade, one of the mounts being a hole formed in the first blade to receive a first end of the first tubular stem, wherein the first tubular handle is located between the first plurality of mounts on the first tubular stem, the first plurality of mounts attaching the first tubular stem to the first blade; and
a second hand paddle having a second tubular stem; a second plurality of mounts mounted on the second tubular stem; a second tubular handle; a second blade attached to the second tubular stem and the second tubular handle, wherein the second plurality of mounts are formed into oppositely disposed ends of the second blade, one of the second plurality of mounts being a hole formed in the second blade to receive a first end of the second tubular stem, wherein the second tubular handle is located between the mounts on the second tubular stem, the second plurality of mounts attaching the second tubular stem to the second blade.

6. The set of hand paddles of claim 5 further including a connecting stem connected to the first and second hand paddles.

7. The hand paddle of claim 1 wherein the hand paddle is operable by hand for water sports.

8. The hand paddle of claim 7 wherein the hand paddle is for full body training.

9. A hand paddle comprising:

a stem;

a tubular handle adjacent to the stem, a blade with a concave surface that is disposed over both the stem and the tubular handle; and a plurality of mounts on oppositely disposed ends of the blade to attach the blade to the stem, wherein at least one mount is a hole formed in the blade to receive a first end of the stem.

10. The hand paddle of claim 9 wherein the tubular handle is to receive the stem, said tubular handle being located between the plurality of mounts.

11. The hand paddle of claim 10 wherein the blade has a thumbs side and a small fingers side.

12. The hand paddle of claim 11 wherein the hand paddle is a first hand paddle connected via a connecting stem to a second hand paddle.

13. The hand paddle of 12 wherein the first hand paddle is graspable by a user's left hand while the second hand paddle is simultaneously graspable by the user's right hand.

* * * * *